US006022299A

United States Patent [19]

Stewart

[11] Patent Number: 6,022,299

[45] Date of Patent: Feb. 8, 2000

[54] GRIPPING DEVICE FOR CABLE PULLEY EXERCISE SYSTEM

[76] Inventor: Lovar Stewart, 6268 180th St. West, Farmington, Minn. 55024

[21] Appl. No.: 09/015,716

[22] Filed: Jan. 29, 1998

Related U.S. Application Data

[60] Provisional application No. 60/036,449, Jan. 29, 1997.

[51] Int. Cl.[7] ..... A63B 21/06

[52] U.S. Cl. ..... 482/102; 482/139

[58] Field of Search ..... 482/94, 99, 82, 482/102, 103, 120, 123, 129, 130, 133, 138, 139; D21/634; 403/157, 154; 473/229, 957

[56] References Cited

U.S. PATENT DOCUMENTS

| | | | |
|---|---|---|---|
| 3,462,156 | 8/1969 | Gentry | 482/129 X |
| 3,708,167 | 1/1973 | Potgieter | 482/138 X |
| 4,229,002 | 10/1980 | Masters | 482/139 X |
| 5,320,443 | 6/1994 | Lien et al. | 403/154 |

OTHER PUBLICATIONS

BodyBuilder's Discount Outlet. Summer 1995 Catalog. pp. 41–42, Sep. 1995.

Lynch, "Get A Grip on Contest–Winning Arms with Levar Stewart," *Natural Bodybuilding*, pp. 39–41 (Aug. 1997).

*Primary Examiner*—John Mulcahy

*Attorney, Agent, or Firm*—Merchant & Gould P.C.

[57] ABSTRACT

The present invention is directed to a gripping device suitable for attachment to a cable pulley exercise machine. In one embodiment, the gripping device of the invention can provide for exercise of upper body muscles with reduced stress on the carpus, radio-ulnar articulation or acromio-clavicular girdle.

The gripping device includes an elongate grip member with a pivot member pivotally mounted in a slot at one end thereof and stop at an opposite end thereof for preventing a hand from slipping off the grip member during exertion of an axial load. The free end of the pivot member has an aperture for attaching to the exercise machine.

13 Claims, 1 Drawing Sheet

GRIPPING DEVICE FOR CABLE PULLEY EXERCISE SYSTEM

CROSS REFERENCE TO RELATED APPLICATIONS

This application claims the benefit of U.S. provisional application no. 60/036,449, filed Jan. 29, 1997.

FIELD OF THE INVENTION

The present invention is directed to a device for exercising the muscles of a human body. Specifically, the disclosure provides a handle grip for use with a cable pulley type weight resistance system.

BACKGROUND OF THE INVENTION

Various apparatuses are available for exercising muscles of the arms and upper body using weight resistance. Some of these apparatuses include the resistant weight as an integral part of the handle used to grasp the apparatus, such as a dumbbell. Other apparatuses include a handle for attaching to cables which provide resistance through a combination of weights and pulleys.

The present invention provides a gripping device for exercising muscles of the arm and upper body when mounted to a cable pulley weight machine.

SUMMARY OF THE INVENTION

The present invention is directed to a gripping device and method for using the gripping device to exercise muscles of a body. The gripping device includes a grip member having a first end and a second end and having a grip bore at the first end of the member. The gripping device also includes a stop member at the second end of the grip member to reduce the likelihood of slippage of the device from exerciser's hand. In addition, the gripping device includes a pivot member having a first pivot aperture and a second pivot aperture through which a spindle pivotally mounts the pivot member to the grip member by passing through the grip bore and the first pivot aperture.

The gripping device according to the invention can be mounted to a cable pulley exercise machine.

A gripping device according to the invention is particularly suited for exercising the upper body muscles of a human body. As used herein, the term upper body muscles includes muscles of the chest, back, arms and shoulders. Examples of muscles which can be exercised using a gripping device according to the invention include: pectoralis major, pectoralis minor, supraspinatus, teres major, teres minor, latissimus dorsi, trapezium, rhomboideus, deltoid (anterior, middle, posterior), biceps brachii, brachialis, coraco-brachilis, triceps brachii (long head, lateral head and medial head), etc.

DETAILED DESCRIPTION OF THE PREFERRED EMBODIMENT

As will be apparent, the utility principles of the present invention can be embodied in many different appearances which do not affect the utility of the device. The appearance of one embodiment of the invention is shown in FIGS. 1–7.

With reference now to FIGS. 1–7 in which identical elements are numbered identically throughout, a description of the preferred embodiment under the present invention will now be provided.

Figure 1:
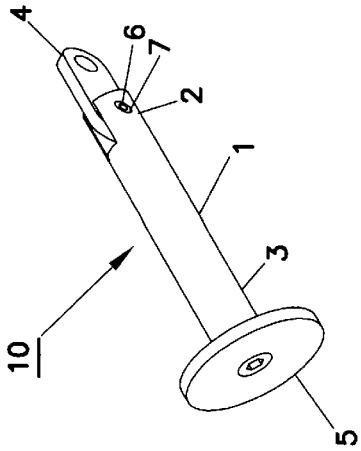
FIG. 1 is a perspective view of a gripping device according to the invention.

FIG. 1 is a perspective view of a preferred embodiment of a gripping device 10 according to the invention. As illustrated, gripping device 10 includes a grip member 1 having a first end 2 and a second end 3. A pivot member 4 is mounted at the first end 2 and a stop member 5 is mounted at the second end 3.

The gripping device is particularly suited for attachment to a cabled pulley exercise machine which provides resistance to movement of the muscle being exercised through weights and pulleys. Cable pulley exercise machines suitable for the invention include known machines. The gripping device of the invention is ergonomically designed for upper body muscle exercise with reduced chance of injury trauma to various carpus regions of the body including the carpus, radio-ulnar articulations and the acromio-clavicular girdle. Muscles that can be exercised according to the invention include, for example, muscles of the upper body including back, chest, and shoulders and muscles of the arm including the forearm and upper arm. Examples of pectoral muscles that can be exercised using the gripping device 10 include the pectoralis major, pectoralis minor, etc. Examples of back and shoulder muscles that can be exercised using the gripping device 10 include: supraspinatus, teres major, teres minor, latissimus dorsi, trapezium, rhomboideus, deltoid (anterior, middle, posterior), etc. Examples of arm muscles that can be exercised using the gripping device 1O include: biceps brachii, brachialis, coraco-brachilis, triceps brachii (long head, lateral head and medial head), etc.

Figure 3:
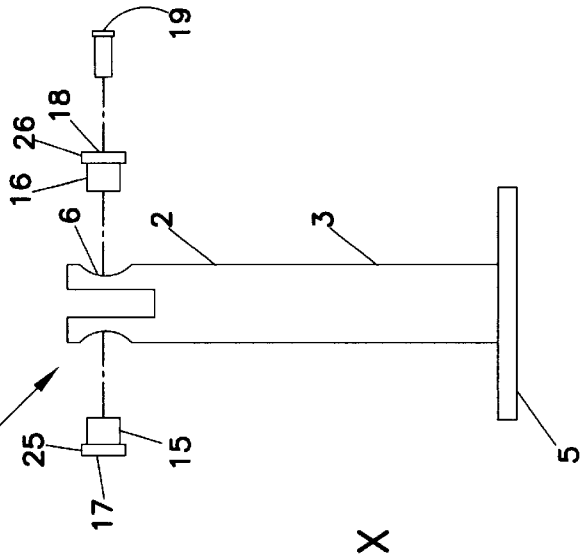
FIG. 3 is a side view of the gripping device of FIG. 1 rotated 90° from the view of FIG. 2.
Figure 2:
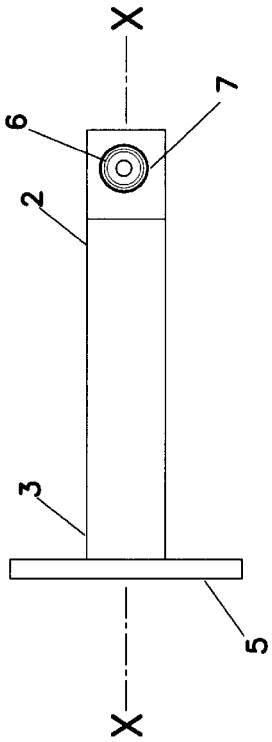
FIG. 2 is a side view of the gripping device of FIG. 1.

Referring to FIGS. 1–3, the grip member 1 of the gripping device 10 is used for holding the device 10 by a human hand. Thus, in addition to the illustrated circular cylindrical shape, the grip member 1 can also be an oval cylinder, rectangular, etc. In addition, the grip member 1 can include ridges and indentations that cooperate with surface contours of a human hand grasping the grip member 1. The grip member 1 can be manufactured from known materials including, for example, aluminum alloy, steel, fiber reinforced carbon, etc.

Figure 5:
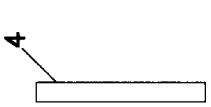
FIG. 5 is a profile view of an embodiment of a pivot member according to the invention.
Figure 4:
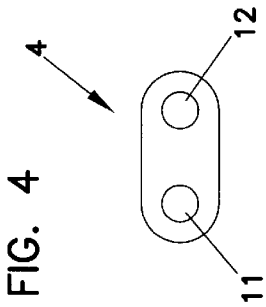
FIG. 4 is a frontal view of an embodiment of a pivot member according to the invention.

The grip member 1 includes a first end 2 and a second end 3. The first end 2 of the grip member 1 includes a bore 6 passing transversely through the longitudinal axis X—X of the grip member 1. The bore 6 provides for attachment of a pivot member 4. A frontal view of the pivot member 4 is shown in FIG. 4, the opposite side being identical in appearance. FIG. 5 is a profile view of the pivot member 4. In the illustrated embodiment, the pivot member 4 has an oval shape and includes a first pivot aperture 11 and a second pivot aperture 12. A spindle 7 (axis) passes through grip bore 6 to rotatably mount pivot member 4 to the first end 2 of the grip member 1. The second pivot aperture 12 is sized to mount to a cable of a weight resistance machine by, for example, a hook attached to the end of the cable of the weight machine (not illustrated).

Referring to FIG. 3, the spindle 7 includes a first flange piece 15 and a second flange piece 16. First flange piece 15 can be passed into bore 6 of grip 1 and through first pivot aperture 11 of pivot member 4. The second flange piece 16 can be passed through the opposite side of grip bore 6. The spindle 7 provides for rotational attachment of pivot member 4 to grip member 1. According to the illustrated embodiment, the first flange piece 15 includes a threaded axial bore 17. Flange piece 16 includes an axial bore 18 that may or may not be threaded. Bolt 19 can be passed through the axial bore 18 of flange piece 16 and into threaded bore 17 of flange piece 15 to securely fasten flange pieces 15 and 16 together.

The pivot member 4 and flange pieces 16 and 17 can be manufactured from suitable materials including, for example, aluminum alloy, steel, etc.

A stop member 5 is mounted to the second end 3 of grip member 1. In the illustrated embodiment, stop member 5 has a circular shape. However, any suitable shape can be used for a stop member 5. The stop member 5 functions as a stop to prevent slippage of the exerciser's hand off of the grip member 1 during use. A stop member 5 can be manufactured from any suitable material including aluminum alloy, steel, etc.

In one embodiment, the grip member 1 can be about 5.75 inches in length and about 1 inch in diameter. Flange pieces 15 and 16 of spindle 7 can be about 0.490 inch in diameter and 0.375 inch in length. The flanges 25 and 26 are about 0.575 inch in diameter and about 0.125 inch thick. The pivot member (camb) 4 can be about 2.25 inches in length and 1.0 inch in width and 0.250 inch thick. The first pivot aperture 11 of pivot member 4 should be of sufficient size to permit rotation around the spindle 7 without excess play. The second pivot aperture 12 should be of sufficient size to pass around a connector, such as a hook, attached to the cable of a cable pulley weight machine. The illustrated stop member 5 is circular and about 3 inches in diameter and 0.25 inch thick.

Figure 6:
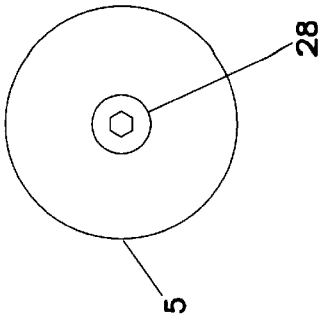
FIG. 6 is an end-on view of a stop member according to the invention.

Referring to FIG. 6, the stop member 5 (bottom plate) can be mounted to the grip member 1 by threading a screw 28 into a threaded bore at the first end 3 of grip member 1. Alternatively, the stop member 5 can be attached to the grip member 1 by welding or other suitable method.

The gripping device 10 according to the invention can be mounted to a cable exercise pulley machine. Typically, known cable pulley exercise machines can include an upper cable pulley and a lower cable pulley. The grip member of the invention can be mounted to either the upper or lower cable pulley position for exercise of different muscle groups of the human body.

When mounted to the upper cable pulley the gripping device of the invention can be used to exercise the triceps brachii muscles by doing, for example, a tricep pushdown movement. Tricep pushdown is done by keeping the elbow stationary at the exerciser's side and then extending the radius and ulna (forearm) in a downward motion away from the upper arm. The unused hand can be placed on the hip or on any suitable object to provide stabilization of the torso. By performing a single arm tricep pull-down, greater concentration can be placed on exercising the long, lateral and medial heads of the triceps. The latissimus adductors can also be exercised by mounting the gripping device 10 to the upper cable pulley. Muscles exercised include, for example, the latissimus dorsi, teres major and serratus anterior.

When mounted to an upper pulley cable the gripping device 10 can also be used to exercise the pectoral muscles. Pectoral muscles of the right and left side can be simultaneously exercised by using a double-cable cross-over machine. An advantage of the present gripping device 10 over known cable cross-over handles is that rotation of pivot member 4 around spindle 7 allows the wrist to be in a pronated position thus working the same muscles that are worked when performing a benchpress.

The gripping device 10 also provides for performing muscle exercises when mounted to a lower cable pulley. Mounting the gripping device to the lower cable pulley orients the stop member 5 facing upward. In this position, front raises for exercising the anterior deltoids can be performed. An advantage of the gripping device 10 over known handles is that the front-raise exercise can be performed with the wrist in a normal position rather than in a pronated or a supinated position. Performing certain exercises with the wrist in a pronated or supinated position potentially puts trauma on the carpus, radio-ulnar articulation or acromio-clavicular girdle.

Another exercise that can be performed when attached to a lower cable pulley is the tricep kickbacks. When performing this exercise, preferably, the hand of the arm opposite that being exercised should be placed on the front of the knee to stabilize the torso. The muscles worked are the long, lateral and medial head of the triceps.

The biceps brachii, brachialis, brachio-radialis muscles can also be exercised when the gripping device is mounted to a lower cable pulley. The back and posterior shoulder muscles, such as the supraspinatus, teres minor, infraspinatus, and posterior deltoid can also be exercised when the gripping device is attached to lower pulley.

From the foregoing detailed description of the present invention, it has been shown how various exercises can be performed using a gripping device as disclosed herein. However, modifications and equivalents of the disclosed concepts for the gripping device as well as exercises which can be performed using the device which would occur to one of ordinary skill in the art, are intended to be included within the scope of the present invention.

I claim:

1. A gripping device for exercising a muscle of a human body, the device comprising:

a grip member having a longitudinal axis passing through a first end and a second end, the first end including a slot in a plane passing through the longitudinal axis and a grip bore in the grip member, the grip bore passing transversely through the longitudinal axis of the grip member;

a stop member at the second end of the grip member, the stop member having a surface normal to the longitudinal axis of the grip member for preventing a hand from slipping off the grip member during exertion of an axial load;

a spindle; and a pivot member having a first pivot aperture and a second pivot aperture, the pivot member being positioned within the slot and attached to the grip member by passing the spindle through the grip bore and the first pivot aperture.

2. The gripping device of claim 1 wherein the second pivot aperture is mountable to a cable pulley exercise machine.

3. The gripping device of claim 1 wherein the spindle comprises a first flange piece and a second flange piece.

4. The gripping device of claim 3 wherein the first and second flange pieces are connected together by a screw.

5. The gripping device of claim 1 wherein the pivot member is oval in shape.

6. The gripping device of claim 1 wherein the stop member is circular in shape.

7. A method for exercising a muscle, the method comprising:

(a) gasping in a first hand, a gripping device attached to a cable pulley weight apparatus having a mobile cable with mobility that is resisted by weight, wherein the gripping device comprises:

a grip member having a longitudinal axis passing through a first end and a second end, the first end including a slot in a plane passing through the longitudinal axis and a grip bore in the grip member, the grip bore passing transversely through the longitudinal axis of the grip member;

a stop member at the second end of the grip member, the stop member having a surface normal to the longitudinal axis of the grip member for preventing a hand from slipping off the grip member during exertion of an axial load;

a spindle; and a pivot member having a first pivot aperture and a second pivot aperture, the pivot member being positioned within the slot and attached to the grip member by passing the spindle through the grip bore and the first pivot aperture;

(b) mobilizing the gripping device to mobilize the cable resisted by the weights.

8. The method according to claim 7 wherein the muscle exercised is an arm muscle.

9. The method according to claim 7 wherein the muscle exercised is an extensor of a human forearm.

10. The method according to claim 7 wherein the muscle exercised is a flexor of a human forearm.

11. The method according to claim 7 wherein the muscle exercised is a human chest muscle.

12. The method according to claim 7 wherein the human chest muscle exercised is a pectoral muscle.

13. An apparatus for exercising muscles of a human body, the apparatus comprising:

(a) a cable and pulley weight machine; and (b) a gripping device attached to the cable pulley weight machine, the gripping device comprising:

a grip member having a longitudinal axis passing though a first end and a second end, the first end including a slot in a plane passing through the longitudinal axis and having a grip bore in the grip member, the grip bore passing transversely through the longitudinal axis of the grip member;

a stop member at the second end of the grip member, the stop member having a surface normal to the longitudinal axis of the grip member for preventing a hand from slipping off the grip member during exertion of an axial load;

a spindle;

a pivot member having a first pivot aperture and a second pivot aperture the pivot member being positioned within the slot and attached to the grip member by passing the spindle through the grip bore and the first pivot aperture.

* * * * *

UNITED STATES PATENT AND TRADEMARK OFFICE

CERTIFICATE OF CORRECTION

PATENT NO. : 6,022,299

DATED : FEBRUARY 8, 2000

INVENTOR(S) : STEWART

It is certified that error appears in the above-identified patent and that said Letters Patent is hereby corrected as shown below:

Col. 1, line 52: "trapezium" should read --trapezius--

Col. 2, line 37: "trapezium" should read --trapezius--

Signed and Sealed this

Eighth Day of May, 2001

*Attest:*

Nicholas P. Godici

NICHOLAS P. GODICI

*Attesting Officer*

*Acting Director of the United States Patent and Trademark Office*